US007273833B2

(12) United States Patent
Uda et al.

(10) Patent No.: US 7,273,833 B2
(45) Date of Patent: Sep. 25, 2007

(54) WATER-SOLUBLE LUBRICANT FOR WARM OR HOT METAL FORMING

(75) Inventors: Kenichiro Uda, Kanagawa (JP); Tatsumi Harada, Kanagawa (JP); Kazushige Fujiyoshi, Gifu (JP)

(73) Assignee: Yushiro Chemical Industry Co., Ltd., Tokyo (JP)

( * ) Notice: Subject to any disclaimer, the term of this patent is extended or adjusted under 35 U.S.C. 154(b) by 328 days.

(21) Appl. No.: 10/676,250

(22) Filed: Oct. 2, 2003

(65) Prior Publication Data

US 2005/0075253 A1 Apr. 7, 2005

(51) Int. Cl.
*C10M 173/00* (2006.01)
*C10M 145/00* (2006.01)
*C08G 63/00* (2006.01)

(52) U.S. Cl. ..... 508/454; 528/271; 508/452

(58) Field of Classification Search ..... 508/454, 508/452; 528/271
See application file for complete search history.

(56) References Cited

U.S. PATENT DOCUMENTS

| | | | | |
|---|---|---|---|---|
| 3,470,098 | A * | 9/1969 | O'Halloran | 508/226 |
| 3,714,042 | A * | 1/1973 | Greenough | 508/393 |
| 3,925,214 | A | 12/1975 | Livingston et al. | |
| 4,401,579 | A | 8/1983 | Kratzer | |
| 4,409,113 | A | 10/1983 | Bertell | |
| 4,454,050 | A | 6/1984 | Bertell | |
| 5,548,031 | A * | 8/1996 | Doi | 525/327.4 |

FOREIGN PATENT DOCUMENTS

| | | | |
|---|---|---|---|
| JP | 55-139498 | | 10/1980 |
| JP | 58-52395 | | 3/1983 |
| JP | 58-84898 | | 5/1983 |
| JP | 59-064698 | | 12/1984 |
| JP | 60-001293 | | 1/1985 |
| JP | 61-103996 | | 5/1986 |
| JP | 62-050396 | | 3/1987 |
| JP | 62-081493 | | 4/1987 |
| JP | 63-89592 | | 4/1988 |
| JP | 63-125599 | A | 5/1988 |
| JP | 63-301297 | A | 12/1988 |
| JP | 01094936 | A * | 4/1989 |
| JP | 01-247494 | A | 10/1989 |
| JP | 05-059119 | A | 3/1993 |
| JP | 11-061167 | A | 3/1999 |
| JP | 2002265974 | A * | 9/2002 |
| JP | 2003206493 | A * | 7/2003 |

* cited by examiner

*Primary Examiner*—Vasu Jagannathan
*Assistant Examiner*—James Goloboy
(74) *Attorney, Agent, or Firm*—Morgan, Lewis & Bockius LLP

(57) ABSTRACT

This invention relates to a water-soluble lubricant for warm or hot metal forming, comprising a high polymer compound which comprises an imide group, which has a weight-average molecular weight of from 1,000 to 1,000,000. The water-soluble lubricants of the invention possess exceptional lubricity for reducing friction between a die and a work-piece, have a minimal adverse effect on the operating environment, and can readily be treated in wastewater.

3 Claims, 1 Drawing Sheet

WATER-SOLUBLE LUBRICANT FOR WARM OR HOT METAL FORMING

BACKGROUND OF THE INVENTION

1. Field of the Invention

This invention relates to a water-soluble lubricant for warm or hot metal forming, and more particularly to a water-soluble lubricant for warm or hot metal forming that is fed between a die and a workpiece; possesses excellent lubricity for reducing the friction therebetween, or excellent release properties for reducing the contact time; has less of an adverse effect on the operating environment and operating efficiency; and can be readily treated as wastewater after use.

The water-soluble lubricant for warm or hot metal forming can be used for forging, extrusion, pressing, wiring drawings, and other types of metal forming in warm or hot regions.

2. Description of the Prior Art

Lubricants are conventionally used in metal forming with the aim of reducing the friction between metal materials and tools or dies, to further smooth the metal forming, and to facilitate the cooling and protection of tools or metals and the release of metal materials from the tools or dies. Examples of such lubricants include graphite lubricants, which are obtained by dispersing graphite powder in oil or water. Graphite lubricants have excellent lubricity and release properties, and are therefore widely used in the metal-forming field.

Graphite lubricants are disadvantageous, however, in the sense that there is a risk that the graphite powder will scatter or deposit on the machinery during application, and will have an adverse effect on the operating environment. Another feature of a graphite lubricant is that the graphite powder plugs the pipes or nozzles coated with the lubricant, and impedes operations as the number of usage cycles increases. Additional work is also needed for cleaning. A resulting drawback is that the operating efficiency of metal forming is markedly reduced. In addition, a graphite lubricant contains graphite powder and is therefore technically difficult to treat as wastewater, and is commonly disposed of by incineration or landfill. In view of this, graphite-free lubricants devoid of graphite powder are needed in order to address the problems of such graphite lubricants.

From this perspective, silicate lubricants and carboxylic acid lubricants have been developed as graphite-free lubricants. A silicate lubricant (JP-A-59-64698) comprising, for example, phosphoric acid, a phosphate, and alkali metal salts of silicic and boric acids is known as one example. Also, known examples of carboxylic acid lubricants include adipates and organic thickeners (JP-A-55-139498), organic thickeners and alkali metal salts of phthalic acid (JP-A-58-84898), alkali metal salts of aromatic carboxylic acids (JP-A-60-1293), organic thickeners and alkali metal salts of maleic acid (JP-A-61-103996), organic thickeners and alkali metal salts of fumaric acid (JP-A-58-52395), alkali salts of aromatic polycarboxylic acids (JP-A-62-50396), alkali metal salts or alkaline-earth metal salts of ligninsulfonic acid (JP-A-62-64698), and polycarboxylic acid reaction products of trimellitic acid and alkali metal hydroxides or alkaline-earth metal hydroxides (JP-A-63-89592).

However, such silicate lubricants tend to deposit nonvolatile lubricant components or mixed accretions comprising the nonvolatile lubricant components and metal abrasion powder in the concavities or corner portions of dies. As a result, underfills are apt to form in a plastically worked product. In addition, lubricants comprising carboxylates and organic thickeners, while devoid of problems associated with the deposition of matter on dies and the adverse effect on the operating environment or operating efficiency, are still inferior to graphite lubricants in terms of lubricity and release properties. Another drawback is that the combined use of thickeners in the lubricants comprising carboxylates and organic thickeners increases the viscosity of these lubricants and, as a result, reduces die life due to a reduction in cooling properties and an increase in the die temperature (increase in the die temperature in the steady state maintained during continuous working).

Furthermore, a reduction in the ability of a lubricant to be treated by flocculation is disadvantageous in that the lubricant cannot be discharged into the environment because of the increased COD value following a wastewater treatment. Since laws and regulations related to environmental protection are believed to become even more stringent in the future, there is currently an urgent need for lubricants that can be readily treated as wastewater.

SUMMARY OF THE INVENTION

An object of this invention, which is intended to solve the aforementioned problems, is to provide a water-soluble lubricant for warm or hot metal forming that is fed between a die and a workpiece; possesses excellent lubricity for reducing the friction therebetween, or excellent release properties; has less of an adverse effect on the operating environment and operating efficiency; and can be readily treated as wastewater.

As a result of extensive research aimed at addressing the aforementioned problems, the inventors discovered that these problems could be resolved by using a specific water-soluble high polymer compound. Specifically, a water-soluble lubricant for warm or hot metal forming that possesses excellent lubricity and release properties, has less of an adverse effect on the operating environmental and operating efficiency, and can be readily treated as wastewater was perfected by using a high polymer compound comprising at least one imide group and whose weight-average molecular weight falls within a specific range.

This invention is described below.

(1) A water-soluble lubricant for warm or hot metal forming, comprising a high polymer compound comprising at least one imide group and whose weight-average molecular weight is 1000 to 1,000,000.

(2) A water-soluble lubricant for warm or hot metal forming according to (1) above, wherein the content of the high polymer compound is 1 to 70 mass percent per 100 mass percent of the water-soluble lubricant for warm or hot metal forming.

(3) A water-soluble lubricant for warm or hot metal forming according to (1) above, wherein the high polymer compound is (A) a high polymer compound obtained by imidated part of a (co)polymer of at least one type of compound selected from among carboxylic acids having carbon-carbon double bonds, and derivatives thereof, or (B) a high polymer compound obtained by imidating part of a copolymer of at least one type of compound selected from among carboxylic acids having carbon-carbon double bonds, or derivatives thereof, and at least one type of compound selected from among sulfonic acids having carbon-carbon double bonds, or derivatives thereof, and from other monomers polymerizable with the monomers constituting the aforementioned high polymer compound.

(4) A water-soluble lubricant for warm or hot metal forming according to (3) above, wherein the at least one type of component selected from among carboxylic acids having carbon-carbon double bonds, or derivatives thereof, is maleic acid or a derivative thereof.

(5) A water-soluble lubricant for warm or hot metal forming according to (1) above, wherein the imidation ratio of the high polymer compound is 1 to 80 molar percent.

The water-soluble lubricant of this invention for warm or hot metal forming comprises a high polymer compound comprising at least one imide group and whose weight-average molecular weight is 1000 to 1,000,000. For this reason, the lubricity and release properties are the same as, or better than, those of conventional graphite lubricants; there is minimal soiling in the area around the machinery, which is a situation different from that observed with such graphite lubricants; and there is iC5s of an ad verse effect on the operating environment or of a reduction in the operating efficiency. In particular, it is possible to enhance the flocculation treatment properties and to reduce the COD value observed following a flocculation treatment and a subsequent wastewater treatment.

An even better effect can be obtained by adjusting the content of the high polymer compound in the water-soluble lubricant for warm or hot metal forming.

The high polymer compound can be readily obtained by performing imidation in accordance with a variety of modes.

The at least one type of compound selected from among carboxylic acids having carbon-carbon double bonds, or derivatives thereof, may be maleic acid or a derivative thereof.

An effect that is highly beneficial to metal-forming processes in a warm or hot region can be obtained by adjusting the imidation ratio of the high polymer compound in an appropriate manner.

Consequently, the water-soluble lubricant of this invention for warm or hot metal forming has excellent lubricity and release properties and can be advantageously used for the forging, extrusion, pressing, wiring drawings, and other types of metal forming designed to be performed in warm or hot regions and required to ensure ease of wastewater treatment.

DETAILED DESCRIPTION OF THE INVENTION

This invention will now be described in further detail.

The high polymer compound comprising the water-soluble lubricant for warm or hot metal forming of this invention comprises at least one imide group in the molecules thereof The term "imide group" refers to an amide that has the imino group (═NH) and is commonly produced by the reaction between ammonia and an acid anhydride. In the case of an acid that generates an acid anhydride by heating alone, an imide may also be produced by heating an ammonium salt thereof. It is possible, for example, to imidate maleic anhydride with ammonia gas. In this invention, no particular restrictions are imposed on the method for forming imide group in the molecule of the high polymer compound. The method may, for example, involve homopolymerizing an imidated derivative obtained by imidating a carboxylic acid having carbon-carbon double bonds, or it may involve copolymerizing this homopolymer with another monomer. Alternatively, it is possible to imidate a homopolymer of a carboxylic acid having carbon-carbon double bonds or the like, or a copolymer of this homopolymer with another monomer.

The weight-average molecular weight of the high polymer compound is 1000 to 1,000,000, preferably 10,000 to 800,000, more preferably 10,000 to 500,000, even more preferably 20,000 to 300,000, particularly preferably 30,000 to 200,000, and ideally 40,000 to 150,000. It is unsuitable for the weight-average molecular weight to fall below 1000, because the lubricity and release properties displayed in this case will be the same as or inferior to those produced by the sodium isophthalate used in conventional graphite-free lubricants. Nor is it suitable for the weight-average molecular weight to exceed 1,000,000, because application by spraying will then be impeded by increased viscosity, die soiling and other problems will be encountered, and the product will become difficult to use despite improved lubricity.

The content of the high polymer compound is not particularly restricted. The content of the high polymer compound is preferably 1 to 70 mass percent, more preferably 5 to 60 mass percent, and ideally 10 to 50 mass percent, per 100 mass percent of the water-soluble lubricant for warm or hot metal forming. A content of 10 to 40 mass percent is particularly preferred. A content of 1 mass percent or greater is preferred because of the possibility to minimize any deterioration in the product shape due to a reduction in lubricity. A content of 70 mass percent or less is preferred because of the possibility to minimize any increase in viscosity that may occur due to a reduction in the solution stability of the lubricant, and to apply the service solution by spraying in a smooth manner.

The high polymer compound is not particularly limited in terms of structure, properties, and the like as long as the molecule thereof have imide group. For example, (A) one or more types of high polymer compounds obtained by imidating part of a (co)polymer of at least one type of compound selected from among carboxylic acids having carbon-carbon double bonds, and derivatives thereof may be used as the high polymer compound. Examples of suitable carboxylic acids having carbon-carbon double bonds include aliphatic carboxylic acids having carbon-carbon double bonds, alicyclic carboxylic acids having carbon-carbon double bonds, and aromatic carboxylic acids having carbon-carbon double bonds. In addition, the carboxylic acids having carbon-carbon double bonds may also be dicarboxylic acids, tricarboxylic acids, or the like, rather than monocarboxylic acids. Specific examples of suitable carboxylic acids having carbon-carbon double bonds include maleic acid, acrylic acid, methacrylic acid, crotonic acid, itaconic acid, and undecylenic acid. Among these, maleic acid is particularly preferred for such use. The carboxylic acids having carbon-carbon double bonds may be used singly, or two or more types may be used.

Esters, acid chlorides, amides, anhydrides, and the like can be cited as examples of the aforementioned derivatives of carboxylic acids having carbon-carbon double bonds. Specific examples of the esters include 2-methyl maleate, monomethyl maleate, monoethyl maleate, and monophenyl maleate. Examples of the anhydrides include phthalic anhydride and maleic anhydride. The derivatives may be used singly, or two or more may be used.

Specific examples of (A) high polymer compounds obtained by imidating part of a (co)polymer of at least one type of compound selected from among carboxylic acids having carbon-carbon double bonds, and derivatives thereof include one or more types of compounds obtained by imidating copolymers of acrylic acid and maleic anhydride, compounds obtained by imidating maleic acid copolymers or maleic acrylic acid polymers, compounds obtained by imidating copolymers of acrylamide and maleic anhydride, and the like.

The high polymer compound may also be (B) one or more types of high polymer compounds obtained by imidating part of a copolymer of at least one type of compound selected from among carboxylic acids having carbon-carbon double bonds, or derivatives thereof, and at least one type of compound selected from among sulfonic acids having carbon-carbon double bonds, or derivatives thereof, and from other monomers polymerizable with the monomers constituting the aforementioned high polymer compound. As used herein, the phrase, "at least one type of compound selected from among carboxylic acids having carbon-carbon double bonds, or derivatives thereof" is as described in detail in the foregoing.

Examples of the aforementioned sulfonic acids having carbon-carbon double bonds include aliphatic sulfonic acids having carbon-carbon double bonds, alicyclic sulfonic acids having carbon-carbon double bonds, aromatic sulfonic acids having carbon-carbon double bonds, and the like. Specific examples of the aforementioned "sulfonic acids having carbon-carbon double bonds" include styrenesulfonic acid, vinylsulfonic acid, vinylcyclohexylsulfonic acid, and the like. Esters, acid chlorides, amides, acid anhydrides, and the like can be cited as examples of the aforementioned derivatives of sulfonic acids having carbon-carbon double bonds. The sulfonic acids that have carbon-carbon double bonds may be used singly, or two or more types may be used.

As used herein, "other monomers" refers to monomers that can constitute the aforementioned high polymer compounds; that can be polymerized with carboxylic acids having carbon-carbon double bonds, or derivatives thereof, and sulfonic acids having carbon-carbon double bonds, or derivatives thereof; and that are monomers other than carboxylic acids having carbon-carbon double bonds, or derivatives thereof, and sulfonic acids having carbon-carbon double bonds, or derivatives thereof. Examples of the aforementioned other monomers include propylene, 1-butene, isobutylene, 1-pentene, 1-dodecene, 1-tetradecene, and other alpha-olefins; styrene and other aromatic vinyl compounds; vinyl chloride and other halogenated vinyl compounds; butadiene, isopropylene, and other diene-based compounds; phenol-based compounds having vinyl, allyl, and other alkenyl groups; derivatives (esters) thereof; and the like. Among these compounds, alpha-olefins are especially preferably used. Using isobutylene is particularly preferable because of the exceptional film formability, coating film strength, and coating film adhesiveness, as well as adequate coating film conformability during working. The aforementioned other monomers may be used singly, or two or more types may be used jointly.

The following are examples of the high polymer compound (B) obtained by imidating part of a copolymer of at least one type of compound selected from among carboxylic acids having carbon-carbon double bonds, or derivatives thereof, and at least one type of compound selected from among sulfonic acids having carbon-carbon double bonds, or derivatives thereof, and from other monomers polymerizable with the monomers constituting the aforementioned high polymer compound: (1) copolymers of at least one type of compound selected from among carboxylic acids having carbon-carbon double bonds, or derivatives thereof, and at least one type of compound selected from among sulfonic acids having carbon-carbon double bonds, or derivatives thereof; (2) copolymers of at least one type of compound selected from among carboxylic acids having carbon-carbon double bonds, or derivatives thereof, and at least one other monomer polymerizable with the monomers constituting the aforementioned high polymer compound; and (3) copolymers of at least one type of compound selected from among carboxylic acids having carbon-carbon double bonds, or derivatives thereof, at least one type of compound selected from among sulfonic acids having carbon-carbon double bonds, or derivatives thereof, and at least one other monomer polymerizable with the monomers constituting the aforementioned high polymer compound. Specific examples thereof include compounds obtained by imidating a copolymer of isobutylene and maleic anhydride, compounds obtained by imidating copolymers of styrenesulfonic acid and maleic anhydride, compounds obtained by imidating copolymers of acrylic acid or methacrylic acid and maleic anhydride, compounds obtained by imidating copolymers of isobutylene, acrylic acid or methacrylic acid, and maleic anhydride, or the like.

The aforementioned high polymer compound in the water-soluble lubricant of this invention for warm or hot metal forming is commonly added as a sodium salt, potassium salt, or other alkali metal salt, or an ammonium salt or other salt, so the aforementioned high polymer compound includes such salts as well. The high polymer compound is present in an ionic state in water, and the high polymer compound of this invention includes compounds in such an ionic state as well. The high polymer compound of this invention may be used singly or as a combination of two or more types.

No particular restrictions are imposed on the proportion of imide group present in the molecule of the high polymer compound of this invention. The imidation ratio, which serves as an index for the proportion of imide group present in the molecule, is normally 1 to 80 molar percent, preferably 5 to 75 molar percent, and more preferably 10 to 70 molar percent. It is preferable for the aforementioned imidation ratio to be 1 molar percent or more, as the resulting lubricity and release properties will be better than with non-imidated compounds. Nonetheless, the aforementioned imidation ratio is preferably kept to 80 molar percent or less, since technical difficulties will be encountered in the imidation process if the imidation ratio exceeds 80 molar percent. It is even more preferable for the aforementioned imidation ratio to be 75 molar percent or less, due to the fact that a long time will be needed to perform imidation if the imidation ratio exceeds 75 molar percent.

Water is normally added to the water-soluble lubricant of this invention for warm or hot metal forming. No particular restrictions are imposed on the amount of water compounded; however, it is normal for 10 to 99.5 mass percent, preferably 40 to 95 mass percent, and even more preferably 60 to 89 mass percent, to be compounded per 100 mass percent of the water-soluble lubricant of this invention for warm or hot metal forming. The viscosity of the lubricant can be lowered and any deterioration in the workability thereof can be controlled by keeping the water content at a level of 10 mass percent or more, so this kind of content is preferred. Also, any decrease in lubricity caused by a lack of a lubricating component can be controlled and any deterioration in the configuration of the plastically worked product can be prevented by keeping the water content at a level of 99.5 wt % or less, so this kind of content is preferred. In this invention, not only is it possible to use a lubricant to which water has been added initially, but it is also possible to add water during use to obtain a specific water-based lubricant. The lubricant may also be further diluted with water on use as needed.

The water-soluble lubricant of this invention for warm or hot metal forming contains the aforementioned high polymer compound as an essential component; in general, however, various other additives may be appropriately added as needed as long as the objects of this invention are not compromised, in order to preserve the fundamental performance thereof as a water-soluble lubricant for warm or hot metal forming. Examples of such additives include antibacterial or antimicrobial agents, defoaming agents, metal rust inhibitors/corrosion inhibitors, surfactants, and the like. It is also possible to add carboxylates; extreme-pressure additives; calcium stearate or other metal soaps; polyethylene wax emulsions, polyethylene wax powders, polyamide powders, polyimide powders, polyethylene terephthalate powders, or other organic powders; and the like with the aim of preventing seizing and to improve other performance attributes in applications in which the product is used under more severe working conditions.

DESCRIPTION OF THE PREFERRED EMBODIMENTS

Figure 1:
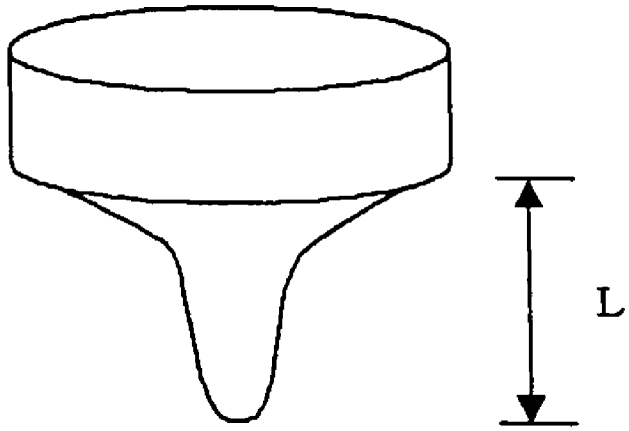
FIG. 1 is a drawing that depicts a formed workpiece subjected to the forward extrusion test described in the examples.

The effects of this invention are described hereinbelow by means of examples, but this invention shall not be limited to these examples.

(1) Preparation of Water-Soluble Lubricant for Warm or Hot Metal Forming

Water-soluble lubricants for warm or hot metal forming of Examples 1 to 6 and Comparative Examples 1 to 7 were prepared by mixing the components shown in Table 1 in the ratio shown in Table 2. To determine the imidation ratios (molar percent) of the high polymer compounds shown in Table 1, the nitrogen content of the high polymer compound was measured by a total nitrogen analyzer ("TOX-100"; Mitsubishi Chemical Corporation), and the result was converted to the imidation ratio. The weight-average molecular weight was also measured using a GPC (gel permeation chromatograph) as the measuring instrument (HPLC system; Tosoh Corporation).

TABLE 1

| | Component | Imidation ratio (%) | Weight-average molecular weight |
|---|---|---|---|
| Example | | | |
| ① | Sodium salt of imidated isobutylene-maleic anhydride copolymer | 50 | 90000 |
| ② | Potassium salt of imidated isobutylene-maleic anhydride copolymer | 35 | 90000 |
| ③ | Sodium salt of imidated isobutylene-maleic anhydride copolymer | 13 | 90000 |
| ④ | Sodium salt of imidated isobutylene-maleic anhydride copolymer | 64 | 60000 |
| ⑤ | Sodium salt of imidated acrylic acid-maleic anhydride copolymer | 50 | 50000 |
| Comparative example | | | |
| ⑥ | Sodium salt of isobutylene-maleic anhydride copolymer | 0 | 180000 |
| ⑦ | Sodium salt of isobutylene-maleic anhydride copolymer | 0 | 6000 |
| ⑧ | Sodium salt of imidated acrylic acid-maleic anhydride copolymer | 50 | 1200000 |
| ⑨ | Sodium salt of polystyrenesulfonic acid-styrene copolymer | 0 | 20000 |
| ⑩ | Sodium salt of imidated acrylic acid polymer | 50 | 500 |
| ⑪ | Sodium isophthalate | — | — |
| ⑫ | Sodium metasilicate | — | — |
| ⑬ | Hydroxyethylcellulose | 0 | 720000 |
| ⑭ | Graphite (Particle size: 5 mM) | — | — |

TABLE 2

| | | Example | | | | | | Comparative Example | | | | | | |
|---|---|---|---|---|---|---|---|---|---|---|---|---|---|---|
| | | 1 | 2 | 3 | 4 | 5 | 6 | 1 | 2 | 3 | 4 | 5 | 6 | 7 |
| ① | Sodium salt of imidated isobutylene-maleic anhydride copolymer | 25 | | | | | 13 | | | | | | | |
| ② | Potassium salt of imidated isobutylene-maleic anhydride copolymer | | 25 | | | | | | | | | | | |
| ③ | Sodium salt of imidated isobutylene-maleic anhydride copolymer | | | 25 | | | | | | | | | | |
| ④ | Sodium salt of imidated isobutylene-maleic anhydride copolymer | | | | 25 | | | | | | | | | |
| ⑤ | Sodium salt of imidated acrylic acid-maleic anhydride copolymer | | | | | 25 | 13 | | | | | | | |
| ⑥ | Sodium salt of isobutylene-maleic anhydride copolymer | | | | | | | 25 | | | | | | |

TABLE 2-continued

| | | Example | | | | | | Comparative Example | | | | | | |
|---|---|---|---|---|---|---|---|---|---|---|---|---|---|---|
| | | 1 | 2 | 3 | 4 | 5 | 6 | 1 | 2 | 3 | 4 | 5 | 6 | 7 |
| ⑦ | Sodium salt of isobutylene-maleic anhydride copolymer | | | | | | | | 25 | | | | | |
| ⑧ | Sodium salt of imidated acrylic acid-maleic anhydride copolymer | | | | | | | | | 25 | | | | |
| ⑨ | Sodium salt of polystyrenesulfonic acid-styrene copolymer | | | | | | | | | | 25 | | | |
| ⑩ | Sodium salt of imidated acrylic acid polymer | | | | | | | | | | | 25 | | |
| ⑪ | Sodium isophthalate | | | | | | | | | | | | 25 | |
| ⑫ | Sodium metasilicate | | | | | | | | | | | | | 5 |
| ⑬ | Hydroxyethylcellulose | | | | | | | | | | | | | 5 |
| ⑭ | Graphite | | | | | | | | | | | | | 25 |
| | Antibacterial/Antimicrobial agent | 0.5 | 0.5 | 0.5 | 0.5 | 0.5 | 0.5 | 0.5 | 0.5 | 0.5 | 0.5 | 0.5 | 0.5 | 0.5 |
| | Water | the rest | | | | | | the rest | | | | | | |

(2) Evaluation of Lubricity Performance

The water-soluble lubricants for warm or hot metal forming in Examples 1 to 6 and Comparative Examples 1 to 7 were diluted tenfold with water to prepare diluted solutions. Lubricity was evaluated by coating a die with the aforementioned diluted solutions under the testing and coating conditions shown in Table 3 below, and performing a forward extrusion test. The results are shown in Table 4. The maximum extrusion load (t) in Table 4 refers to the average value taken over three rounds of testing. The extrusion length (mm) is the length ("L" in FIG. 1) minus the flange thickness, and refers to the average value taken over three rounds of testing. In the lubricity evaluation, the extrusion lengths and maximum extrusion loads were correlated, and instances where the extrusion length was substantial were normally considered to indicate that the maximum extrusion load had decreased. Accordingly, a smaller maximum extrusion load and a greater extrusion length were indicative of better lubricity, which was evaluated based on the following ranking:

TABLE 3-continued

| | | | |
|---|---|---|---|
| | | Temperature | 220° C. (Only the lower die was heated) |
| | Test piece | Material | S45C (*JIS) |
| | | Dimensions | f30 × 30 mm |
| | | Temperature | 1000° C. (Heating time: 10 min) |
| | The number of test cycle | | 3 |
| Coating conditions | Spray | Equipment | Tough airless |
| | | Nozzle diameter | f 0.6 mm (Round spray) |
| | | Discharage rate | 3 ml/s |
| | | Coating duration | 1 s |
| | Air blow | | None |

*JIS: Japan Industrial Standards

TABLE 4

| | Example | | | | | | Comparative example | | | | | | |
|---|---|---|---|---|---|---|---|---|---|---|---|---|---|
| | 1 | 2 | 3 | 4 | 5 | 6 | 1 | 2 | 3 | 4 | 5 | 6 | 7 |
| Extrusion length (mm) | 24.8 | 24.3 | 23.7 | 24.5 | 24 | 24.4 | 24.1 | 23 | 24 | 22.9 | 20.4 | 21.8 | 23.1 |
| Maximum extrusion load (t) | 70.3 | 71.2 | 71.8 | 70.8 | 72 | 71.1 | 72.3 | 75.1 | 72 | 75.5 | 93.5 | 92 | 74.2 |
| Evaluation of lubricity | ⊙ | ⊙ | ⊙ | ⊙ | ⊙ | ⊙ | ⊙ | Δ | ⊙ | Δ | X | X | ○ |
| Operating environment | ⊙ | ⊙ | ⊙ | ⊙ | ⊙ | ⊙ | ⊙ | ⊙ | ○ | ⊙ | ⊙ | ⊙ | X |
| COD following effluent treatment | ⊙ | ⊙ | ⊙ | ⊙ | ⊙ | ⊙ | ○ | ○ | ○ | Δ | ⊙ | X | Δ |

<1>"⊙": superior to Comparative Example 7 (graphite lubricant)

<2>"○": equivalent to Comparative Example 7

<3>"Δ": somewhat inferior to Comparative Example 7, but superior to Comparative Example 6 (carboxylate lubricant)

<4>"X": equivalent or inferior to Comparative Example 6

TABLE 3

| | | | |
|---|---|---|---|
| Test conditions | | Testing machine | KOMASTU MAYPRES 300 Ton |
| | | Die gap | 5.7 mm |
| | | Working speed | Approximately 200 mm/s (50 spm) |
| | Die | Material | SKD-61 (HRC 55) |
| | | Surface | Sanded with #320 sandpaper |

(3) Evaluation of Operating Environment

The operating environment was evaluated according to the following ranking by visually assessing the extent to which the lubricant had scattered during application, deposited on the machinery, or soiled the area around the machinery. The results are shown in Table 4 above.

<1>"⊙" equivalent or superior to Comparative Example 6 (carboxylate lubricant)

<2>"○": inferior to Comparative Example 6, but equivalent or superior to Comparative Example 7 (graphite lubricant)

<3>"X": equivalent or inferior to Comparative Example 7.

(4) Evaluation of Wastewater Treatability

A flocculation treatment was conducted and wastewater treatability evaluated according to the method below.

Specifically, sulfuric acid was added and acidic conditions were established (pH=3 to 4) under stirring (120 to 150 rpm) in diluted solutions that had been obtained by a method in which each of the water-soluble lubricant for warm or hot metal forming obtained in Examples 1 to 6 and Comparative Examples 1 to 7 was diluted tenfold with water. Next, aluminium sulfate (8% in terms of $Al_2O_3$) was added, and a neutralizer (sodium hydroxide aqueous solution) was further added to bring the pH to from 6 to 8. The mixture was stirred further at a rate of 30 to 60 rpm, whereupon 25 ppm of an anionic polymer flocculant ("EDP Flock 353"; Kurita Water Industries Ltd.) was added, the mixture was left to stand for 30 min, and the supernatant was subsequently filtered using No. 5A filter paper. The COD values of the filtrates were measured by potassium permanganate titration (JIS K 0102). Wastewater treatability was evaluated by assigning "◎" to those examples that had a post-flocculation treatment COD value of less than 1000 ppm; "○" to those of 1000 ppm or more, but less than 5000 ppm; "Δ" to those of 5000 ppm or more, but less than 10,000 ppm; and "X" to those of 10,000 ppm or greater. The results are shown in Table 4 above.

(5) Results of the Examples

The results given in Table 4 reveal that Comparative Example 7, which is a graphite lubricant that has been used extensively in the past, exhibited fairly good lubricity but had a poor COD value following wastewater treatment, and poor operating environment results. Furthermore, Comparative Example 6, which is a non-graphite lubricant, demonstrated good operating environment results, but was judged to have poor lubricity and a poor COD value following wastewater treatment.

Comparative Examples 1, 2, and 4, which are water-soluble lubricants designed for warm or hot metal forming and provided with a high polymer compound imidation ratio of 0% (i.e., no imide group were present in the molecule), were judged to have had poorer COD values following wastewater treatment than those in the examples.

Moreover, the lubricity of Comparative Examples 2 and 4 was judged to have been less than satisfactory. Comparative Example 3, which contain a high polymer compound whose weight-average molecular weight exceeds the upper limit of this invention, was also judged to have had a less-than-satisfactory COD value following wastewater treatment, while Comparative Example 5, which contains a high polymer compound whose weight-average molecular weight is below the lower limit of this invention, was judged to have a good COD value following wastewater treatment, but less-than-satisfactory lubricity.

In contrast to the above results, each of the water-soluble lubricants for warm or hot metal forming pertaining to Examples 1 to 6, all of which are within the ranges of this invention, had low extrusion loads (70 to 72 tons) and considerable extrusion lengths (24 mm or higher), and these results were judged to indicate exceptional lubricity. Moreover, the results of the operating environment and COD values following wastewater treatment tests in Examples 1 to 6 were judged to have been exceptional in all cases.

The above results demonstrate that a lubricant with various exceptional properties can be obtained by adjusting the constitution of this invention through the use of a high polymer compound whose molecule contain imide group and whose weight-average molecular weight is optimized.

What is claimed is:

1. A water-soluble lubricant for warm or hot metal forming, comprising a high polymer compound comprising at least one imide group and whose weight-average molecular weight is 1,000 to 1,000,000 and the imidation ratio is 1 to 35 molar percent, wherein said high polymer compound is (B) an imidated alpha-olefin and maleic anhydride copolymer obtained by imidating part of a copolymer of maleic anhydride and alpha-olefin.

2. The water-soluble lubricant of claim 1, wherein the content of the high polymer compound is 1 to 70 mass percent per 100 mass percent of the water-soluble lubricant.

3. The water-soluble lubricant of claim 1, wherein said alpha-olefin is isobutylene.

* * * * *